US005218332A

United States Patent [19]

Blanchard et al.

[11] Patent Number: 5,218,332

[45] Date of Patent: Jun. 8, 1993

[54] SWITCH DEVICE

[75] Inventors: Christian Blanchard, Rueil Malmaison; Michel Lauraire, Courbevoie; Didier Vigouroux, Jouy le Moutier, all of France

[73] Assignee: Telemecanique, France

[21] Appl. No.: 840,970

[22] Filed: Feb. 26, 1992

[30] Foreign Application Priority Data

Feb. 28, 1991 [FR] France ..... 91 02395

[51] Int. Cl.[5] ..... H01H 67/02

[52] U.S. Cl. ..... 335/132; 335/202

[58] Field of Search ..... 335/131-132, 335/202; 200/303, 309

[56] References Cited

U.S. PATENT DOCUMENTS 4,355,216 10/1982 Kane et al. ..... 200/303
4,644,308 2/1987 Guery et al. ..... 335/128
4,800,352 1/1989 Haury et al. ..... 335/132
4,973,929 11/1990 Duchemin ..... 335/132
4,990,875 2/1991 Lemarquand et al. ..... 335/131

*Primary Examiner*—Lincoln Donovan
*Attorney, Agent, or Firm*—William A. Drucker

[57] ABSTRACT

A switch device comprises at least one switch comprising in a casing at least one fixed contact cooperating with a mobile contact movable in a switching chamber by a tripping mechanism. The casing comprises a base fastened to walls which delimit a channel constituting the switching chamber which cooperates with a closure module carrying an electrical conductor which connects the fixed contact to a connecting terminal, the combination of the casing and the module constituting the switching chamber. This design facilitates industrial manufacture of the device and improves its insulating and operating qualities.

11 Claims, 4 Drawing Sheets

SWITCH DEVICE

BACKGROUND OF THE INVENTION

Field of the Invention

The present invention concerns a switch device comprising in a case at least one pole consisting of at least one fixed contact cooperating with a mobile contact adapted to be moved in a switching chamber relative to said fixed contact by at least one tripping mechanism.

In some existing switch devices some components are grouped together in subsystems accommodated in the basic case.

For example in the patents EP - 79818 and EP - 79819 fixed contacts and a mobile contact-holder bridge are mounted in an insulating cartridge accommodated in a housing in the device. The cartridge is made in two parts joined together and forming a chamber in which the components are housed. The cartridge is inserted into the case through an opening on a bottom or base side.

An object of the present invention is to provide a new switching chamber arrangement associated with a pair of contacts in order to achieve advantages from the point of view of electrical operation and from the point of view of industrial manufacture and assembly of the components.

This arrangement is achieved in a simple way by a unitary construction case with no independent base and by an insulating part supporting a conductor connecting a fixed contact to a connecting terminal and possibly other electrical components.

From the point of view of electrical operation the invention makes it possible to achieve good insulation between phases (leakage paths, switching gases, etc). It makes it possible to use arc extinguishing means (magnetic U, coils, etc) insulated in a simple manner from the other components of the phase concerned and from the other phases. It makes it possible to use a different insulating material for the switching chamber and for the case. It makes it possible for the switching chamber associated with one pole to be easily insulated from the switching chamber associated with another pole.

With regard to industrial manufacture and assembly of the components, the invention makes it possible to reduce the number of parts, especially when arc extinguishing means are used. It makes it possible to assemble the component parts of the switching chamber more easily. It makes it possible to assemble magnetothermal tripping components easily. It also makes it possible to mount a removable assembly carrying the mobile bridges easily. It makes it possible to manufacture a unitary construction case with no independent base which provides good electrical insulation and good mechanical strength.

SUMMARY OF THE INVENTION

The device in accordance with the invention is characterized in that the case has a fixing base joined to insulating walls constituting a channel delimiting the, switching chamber and in that said channel of the case cooperates with an insulating drawer carrying an electric conductor which connects the fixed contact to the connecting terminal, the combination of the case and the conductor-holder closure module constituting the switching chamber.

According to one feature, the case forms a channel for each pole adapted to receive two conductor-holder drawer, the two drawer being disposed one on each side of a contact-holder module comprising at least one mobile contact bridge cooperating with said fixed contacts.

According to another feature, each drawer comprises a conductor-holder apron and two side walls defining an internal chamber opening into the channel on the side towards the central part, these walls being inserted between two adjoining walls of the case so as to be adjacent thereto.

According to another feature, each drawer has a transverse dividing wall delimiting the switching chamber on the side towards the central part and a gas expansion chamber on the side towards the outside.

According to another feature, the two drawers associated with the same pole are inserted in two opposite channels of the case by movement in translation in opposite directions.

According to another feature, each drawer comprises arc extinguisher means insulated between the drawer and at least one wall of the case.

According to another feature, the conductor carried by a drawer has two arc extinguisher loops each pressed against one side surface of the drawer facing a wall of the case and joined together by a part carrying the fixed contact and positioned in the chamber of the drawer forming the switching chamber.

According to another feature, the part of the conductor carrying the fixed contact is extended within the chamber of the drawer by a tongue constituting the deflector on which arcing occurs.

The invention will now be described in more detail and by way of example with reference to embodiments shown in the appended drawings.

DETAILED DESCRIPTION OF THE INVENTION

Figure 1:
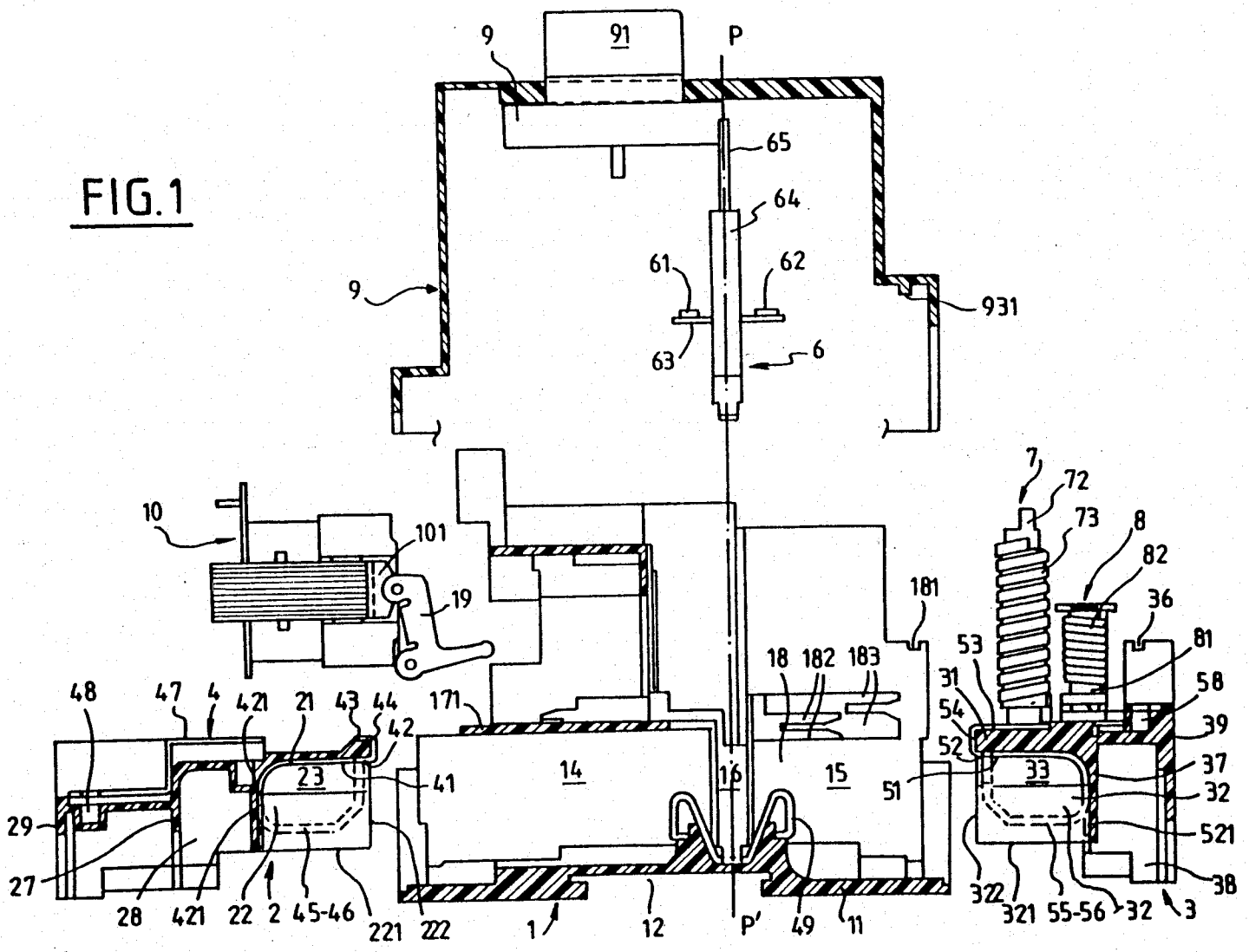
FIG. 1 is an exploded view of a device in accordance with the invention in cross-section on a plane through an axis of movement in translation of the mobile contact

The device shown in the drawings is a multipole contactor/circuit-breaker. It could equally well be a single-pole device.

The device comprises a unitary construction case 1 molded from an electrically insulating (plastics) material. The base 11 of the case has a groove 12 cooperating with retractable clipping means for clipping the device onto a standardized section. There is no opening in the base 11.

Figure 3:
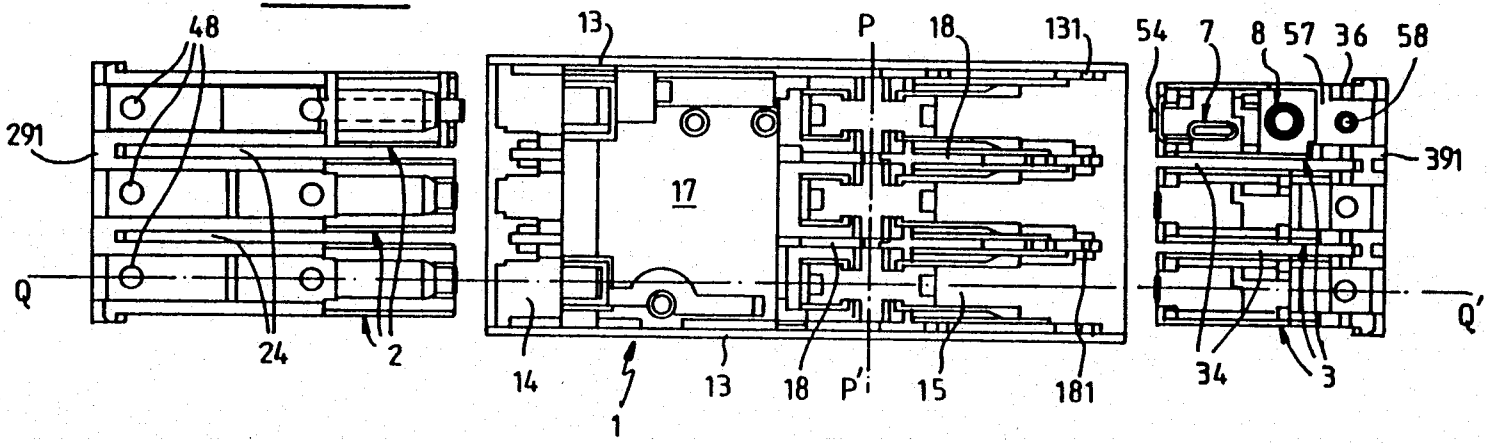
FIG. 3 is an exploded top view showing a case and drawer constituting the device.
Figure 5:
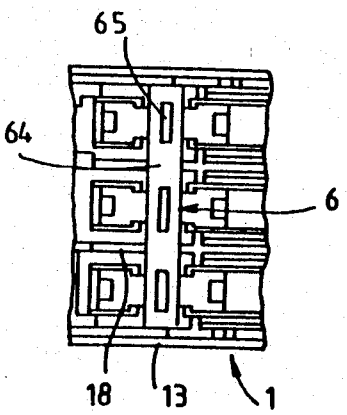
FIG. 5 is a partial top view showing the assembly from FIG. 4 incorporated into the case.

The base 11 of the case is directly attached to exterior walls 13 and insulating interior walls 18. The walls constitute in pairs with the base 11 channels 14 or 15 delimiting switching chambers. The walls 13 and 18 are perpendicular to the flat base 11 and parallel to each other (in a direction QQ' in FIG. 3). The channels 14 and 15 are aligned on axes parallel to QQ' and extend to either side of a plane PP'.

Each channel 14 or 15 cooperates with a respective drawer 2 or 3 which delimits the respective switching chamber 23 or 33 in conjunction with the case and carries a respective conductor 4 or 5.

For each pole the device comprises two fixed contacts 41 and 51 and a bridge 63 carrying mobile contacts 61 and 62. The mobile contacts 61, 62 move in translation relative to the fixed contacts perpendicularly to the line passing through the fixed contacts. The mobile contacts have a plane of movement and symmetry PP'.

Each fixed contact 41 or 51 of the same pole is carried by a respective drawer 2 or 3 inserted into a channel 14 or 15 of the case.

Each fixed contact 41 or 51 is formed on the respective conductor 4 or 5 connecting it to a respective connecting terminal 48 or 58. Each terminal 48 or 58 is mounted on the drawer 2 or 3 and is adapted to be connected to a power line.

The two drawers 2 and 3 of the same pole are inserted into the respective opposite and aligned channels 14 and 15 in the case. The channels 14 and 15 of one pole are open to the outside through two openings on opposite sides of the case. The two modules 2 and 3 are inserted in the case 1 by movement in translation in opposite directions towards the plane PP' and parallel to a direction QQ' (FIG. 3) orthogonal to PP' and parallel to the base of the case.

Like the case the drawers 2 and 3 are molded from electrically insulating (plastics) material. The material of the drawers 2 and 3 may be different than the material of the case 1.

Each of the drawers 2 and 3 has an upper apron 21 or 31 connected to two respective sidewalls 22 and 32.

These walls define in each drawer a respective internal chamber 23 or 33 forming a switching chamber.

When assembled together, the combination of the drawers 2 and 3 and the casing 1 forms a closed switching chamber.

Each internal chamber 23 or 33 of the drawer 2 or 3 opens into the associated channel 14 or 15 on the side facing towards the central part (the plane PP').

The two side walls 22 or 32 and the adjoining upper apron 21 or 31 have a U-shape transverse cross-section (parallel to PP').

The walls 22 or 32 of the same drawer are inserted between two neighbouring walls of the case so as to be adjacent thereto.

Because of the U-shape transverse cross-section of each drawer 2 or 3 the internal chamber 23 or 33 therein is open towards the bottom of the respective channel.

Each drawer 2 or 3 has a transverse dividing wall 27 or 37 (parallel to PP') which delimits on the side facing towards the central part the switching chamber 23 or 33 and on the outside a respective gas expansion chamber 28 or 38. The switching and expansion chambers communicate with each other.

Each drawer 2 or 3 has a respective transverse base 29 or 39 closing at least partially on the exterior of the case firstly the switching chamber 23 or 33 and the adjoining expansion chamber 28 or 33 and secondly the respective channel of the case.

The lower edges 221 and 321 of the side walls of the drawer bear on contours of the base of the casing. In the assembled position the central edges 222 and 322 of the side walls of the drawer are spaced from each other and facing each other in such a way as to form a space 16 enabling the fitting of a module 6 to be described later.

The drawer 2 and 3 are immobilized in translation relative to the case in the direction QQ' parallel to the base by abutments. The drawer 3 is immobilized in a direction perpendicular to the base 11 by abutments formed on the walls of the case. The drawer 2 is immobilized in a direction perpendicular to the base 11 by a wall 171 of the case. The wall 171 extends parallel to the base 11 and closes the channels 14 at the top. It separates the drawers 2 and their associated conductors 4 from a solenoid 10 to be described later.

The fixed contacts 41 and 51 are disposed on the conductors 4 and 5 on the inside surface of the apron 21 or 31.

The fixed contacts 41 and 51 are positioned towards the central part while the connecting terminals 48 or 58 are positioned at the sides of the case.

Each conductor 4 or 5 has a central part 42 or 52 forming a tongue joined by a bridge 44 or 54 to two parallel side loops or branches 45 and 46 or 55 and 56 which are U-shaped and joined to a conductive part 47 or 57 connected to the terminal 48 or 58. The U-shape loops are open upwards, assuming that the base is lowermost. The fixed contact 41 or 51 is disposed on the central part 42 or 52 and faces downwards. The central part 42 or 52 carrying the fixed contact and positioned in the chamber of the drawer is extended within the chamber by a tongue 421 or 521 constituting a deflector conductor on which arcing occurs.

The bridge 44 or 54 joining the two loops and in contact with the drawer via its front surface is extended by a respective branch 43 or 53 bent over the top of the drawer.

The two loops or branches 45, 46 or 55, 56 are pressed against the side surfaces of their respective drawers 2 and 3. The conductive part 47 or 57 is disposed on the top of the drawer. The tongue 421 or 521 follows the profile of the internal chamber 23 or 33.

A metal deflector 49 is housed in the channels 14 and 15 delimiting the switching chambers. The deflector 49 is positioned on the base 11 of the case which forms the bottom of these channels and is held in place by the drawers 2 and 3.

The drawers 2 or 3 are respectively separated by spaces 24 or 34 appropriate to the walls 18.

The various adjacent drawers 2 on the same side of the plane PP' are joined together to form a unitary construction assembly. Likewise, the drawers 3 on the same side of the plane PP' are joined together to form a unitary construction assembly.

The drawers 2 are joined by bridges 291 forming part of the base 29. Likewise, the drawers 3 are joined by bridges 391 forming part of the bottom 39.

Alternatively, the various drawers 2 or 3 situated on the same side and belonging to different poles could be independent of each other.

Figure 4:
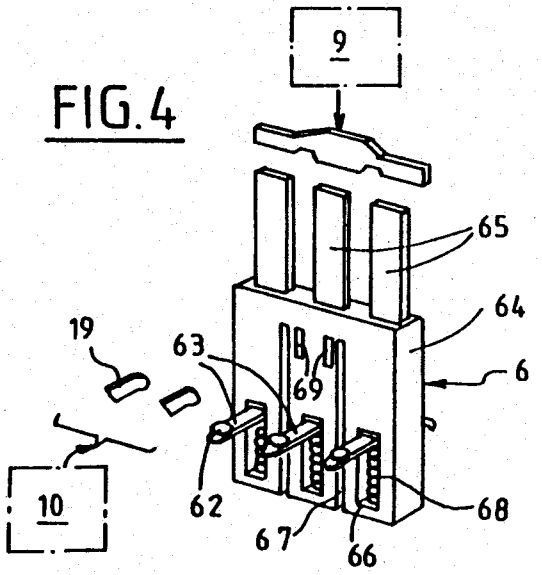
FIG. 4 is a perspective view of a mobile contact-holder assembly.
Figure 6:
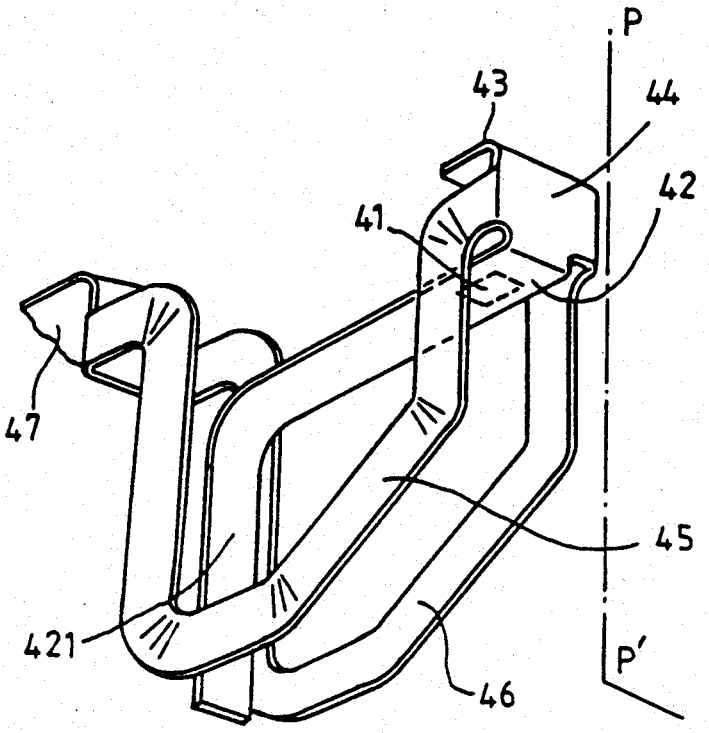
FIG. 6 is a perspective view of a conductive part connecting a fixed contact to a terminal and adapted to be mounted on a drawer accommodated in the case of the device.
Figure 7:
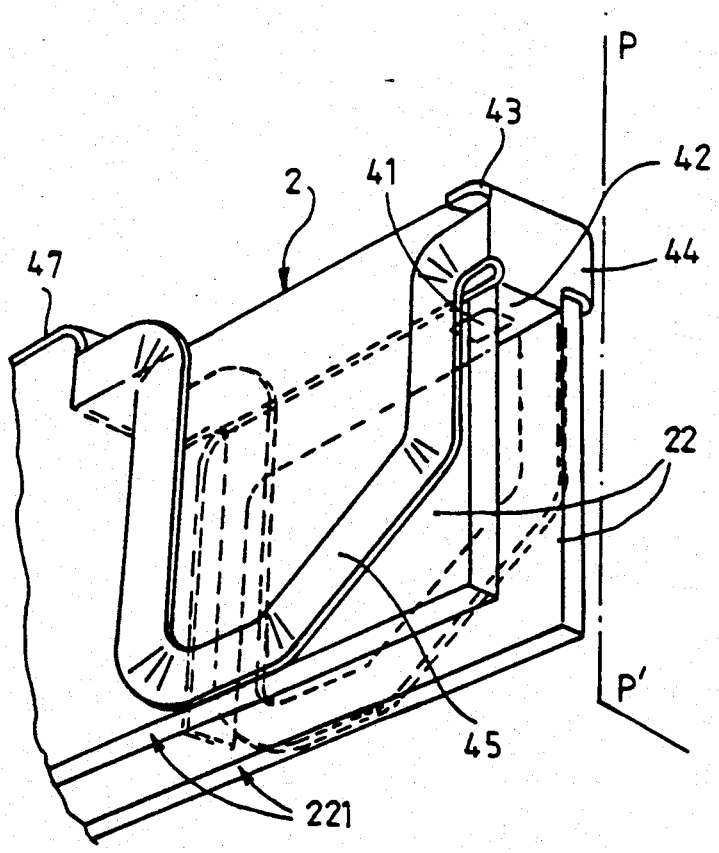
FIG. 7 is a perspective view of the conductive part from FIG. 6 mounted on the associated drawer.

The mobile bridges 63 carrying the mobile contacts 61 and 62 are mounted on a contact-holder module 6 shown diagrammatically in FIG. 4.

The bridges 63 are placed between the fixed contacts and the base 11 of the case.

The contact-holder module 6 comprises a mobile support 64 in which the contact bridges 63 and operating plungers 65 are disposed. Each contact bridge 63 is slidably mounted in a window 68 of the support 64. An associated contact compression spring 66 urges each bridge 63 upwards in the direction which closes the contacts. By way of example, in the embodiment shown, the spring 66 is housed in the window. Each of the bridges 63 can be moved in the direction which opens the contacts by the associated plunger 65. The module comprises as many plungers as poles.

The module 6 is inserted in the plane PP' into a housing 16 of the case formed between the walls 13 between the drawers 2 and 3. The support 64 has slots 67 which receive the walls 18 of the case. The mobile support 64 can slide in the plane PP' relative to the case, guided by contact with the walls of the case.

The conductor 4 associated with the drawer 2 connects the fixed contact directly to the connecting terminal 48. The conductor 5 associated with the drawer 3 connects the fixed contact to the connecting terminal 58 via a magnetic and/or thermal tripping assembly 7, 8 providing protection against fault currents.

The tripping assembly 7, 8 carried by the drawer 3 comprises a thermal tripping device 7 and an electromagnetic tripping device 8.

The thermal tripping device 7 associated with each pole comprises a flat bimetal strip 71 lying in a plane parallel to the plane QQ'. Its bottom end is carried by the drawer 3 and it has a free end 72. A heating element 73 insulated from the bimetal strip is wound around the bimetal strip. The heating element is electrically connected at one end to the conductor 5 and at the other end to the free end of the bimetal strip. The free ends 72 of the tripping devices operate through a differential system adapted to actuate the plungers 65 of the module 6 through a mechanism 9.

The electromagnetic tripping device 8 of each pole comprises a coilformer 81 around which is wound a control coil 82. It also comprises a mobile plunger core sliding inside the coilformer. A return spring is mounted between the core and the coilformer. The plunger core extends axially out of the coilformer and operates on the mechanism 9 in turn operating on the plungers of the module 6.

The bridges of the module 6 can therefore be moved in response to a fault detected by the magnetic and thermal tripping assembly after a latch 9 to be described later is tripped. The bridges of the module 6 can also be moved by electrodynamic repulsion or by an actuator mechanism 91 or the like which operates on the latch and on the solenoid.

The tripping devices 7 and 8 are housed between the walls 18 of the case and between each side wall 13 and the adjacent wall 18. The planes of the bimetal strips 71 are parallel to the walls 18.

The latch tripping mechanism 9 common to all poles is disposed in a relatively narrow central housing 17. The mechanism 9 is coupled to a manual operating and reset button 91 which is used to reset, close and open it. This button could be replaced by pushbuttons or rocker buttons as appropriate to the particular type of latch 9.

A solenoid 10 which operates the contactor is housed in the case 1 and operates on the module 6. In a manner that is known in itself, the solenoid comprises a fixed magnetic circuit, a mobile armature 101 and a coil connected to terminals by a switch. The switch can be actuated in a manner that is known in itself. The mobile armature 101 of the solenoid is coupled to a return spring and operates through the intermediary of a button 91 and/or another actuator device.

The mobile armature 101 of the solenoid operates on a mobile swing-arm 19 articulated about a pin 191 on the case and operating the mobile support 64 of the module 6. The swing-arm has fingers moving in lateral notches 69 of the support 64 to move it and operate the contacts.

The walls 13 and 18 have slideways 182 and 183 cooperating with bases of the tripping devices 7 and 8 to center and hold in position the tripping devices 7 and 8. These means determine the positioning reference points of the tripping devices 7 and 8 relative to the case.

The case 1 is covered by a lid 93.

The drawer 3 have notches 36 which when the drawer are inserted are aligned with notches 181 in the walls 131 or the side walls 13. Lugs 931 on the cover 93 are inserted in the notches to immobilize the drawer 3. The drawer 2 can be retained in the same way.

So-called "deionization" plates can be disposed near the contacts to facilitate rapid interruption of the current. These plates can be mounted on the drawer or on the case.

Alternatively, the thermal tripping devices 7 (or the electromagnetic tripping devices 8) could be mounted on the modules 2, the modules 3 carrying the tripping devices 8 (or 7).

The operation of the device will now be described.

The drawer 2 and 3 and the associated components are assembled separately. The assembled drawer 2 and 3 are then inserted into the channels of the case 1.

Figure 2:
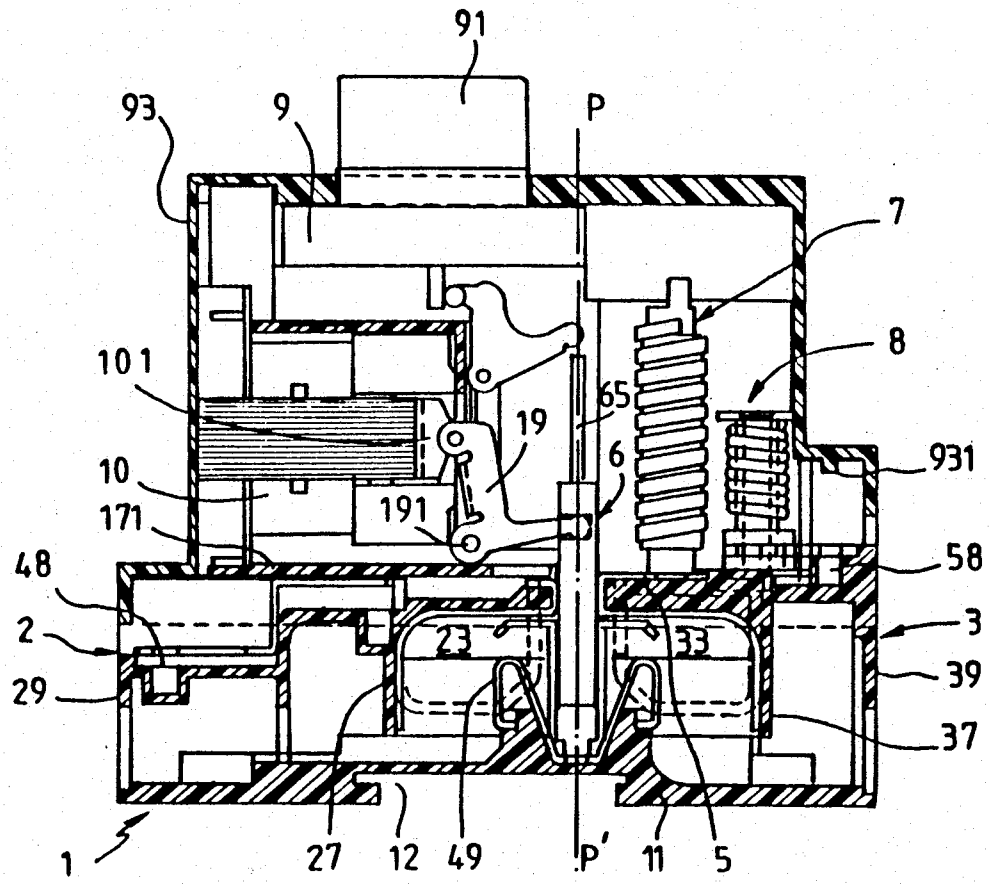
FIG. 2 is a view of the assembled device in cross-section on the same cross-section plane as FIG. 1.

When the contacts are opened when live the mobile contacts move down and away from the fixed contacts. An arc is struck between the contacts. When the short-circuit current flows from the terminal 48 to the terminal 58 through the conductors 47, 45 and 46, 44, 42, 43, the arc, the deflector 49 and the corresponding components associated with the drawer 3, the conductive loops 45, 46 create in the area through which the arc passes and the surrounding region a magnetic field in the direction perpendicular to the plane of FIGS. 1 and 2.

The interaction of this magnetic field and the current flowing in the arc causes the application to the arc of forces which shift and lengthen it.

The arc extinguisher loops are insulated between the walls of the drawer and the walls of the case.

Modifications may be made to the embodiment described.

In an alternative embodiment, each of the two drawer is inserted into the case in a direction at an angle to the base of said casing.

There is claimed:

1. Switch device comprising at least a switch having first and second fixed contacts which cooperate with a mobile contact bridge, said device further comprising:

a case forming an insulating channel;

first and second removable insulating drawers which are slidingly engaged into said channel, said first and second drawers carrying respectively said first and second fixed contacts;

a contact-holder module located between said drawers and comprising said mobile contact bride.

2. Device according to claim 1 wherein said case forms a plurality of insulating parallel channels, each being provided with said first and second drawers.

3. Device according to claim 1 wherein each drawer has a forward part formed with two lateral parallel walls connected together by a conductor-holder apron so as to present a U-shaped cross-section and to delimit a switching chamber opened in front of said contact-holder module, said apron having an inner surface which supports said fixed contact.

4. Device according to claim 3 wherein each drawer engaged in a channel comprises arc extinguisher means located between said lateral walls and said case so as to be electrically insulated from an arc occurring inside said switching chamber.

5. Device according to claim 3 wherein each drawer engaged in a channel comprises a conductor having two arc extinguisher loops each extending between one of said lateral walls and said case and joined together by a conducing part carrying said fixed contact.

6. Device according to claim 5 wherein said conducing part is extended within said chamber by a tongue constituting a deflector on which arcing extends.

7. Device according to claim 1 wherein one of said drawer carries a magnetic and/or thermal tripping assembly.

8. Device according to claim 1 wherein said channel is limited by a bottom constituting a bottom portion of said case and comprises a metal deflector positioned on said bottom portion.

9. Device according to claim 7 wherein said case comprises means for centering and positioning said tripping assembly mounted on a drawer.

10. Device according to claim 1 wherein said channel comprises two opposite openings through which said first and second drawers are inserted by a translational movement in opposite directions.

11. Device according to claim 1 wherein said contact-holder module comprises:

a mobile support actuated by a solenoid and comprising a plurality of guiding means, a plurality of mobile plungers slidingly guided by said guiding means, a plurality of contact bridges respectively fixed to said plungers, and a common latch tripping mechanism acting on said plungers.

* * * * *